US006969013B2

(12) United States Patent
Melancon et al.

(10) Patent No.: US 6,969,013 B2
(45) Date of Patent: Nov. 29, 2005

(54) HIGH PRESSURE FLUID SPRAYING APPARATUS

(75) Inventors: Randy Melancon, Houma, LA (US); Doug Poiencot, Houma, LA (US)

(73) Assignee: Kenergy LLC, Houma, LA (US)

( * ) Notice: Subject to any disclaimer, the term of this patent is extended or adjusted under 35 U.S.C. 154(b) by 77 days.

(21) Appl. No.: 10/777,400

(22) Filed: Feb. 12, 2004

(65) Prior Publication Data

US 2005/0178855 A1 Aug. 18, 2005

(51) Int. Cl.[7] ..... F23D 11/10

(52) U.S. Cl. ..... 239/423; 239/124; 239/310; 239/332; 239/419; 239/532

(58) Field of Search ..... 239/124, 310, 239/318, 303, 304, 305, 332, 525, 530, 532, 239/419, 423; 137/888, 891, 893, 894, 896

(56) References Cited

U.S. PATENT DOCUMENTS

| | | | | |
|---|---|---|---|---|
| 1,153,401 | A * | 9/1915 | Milne | 239/562 |
| 2,692,564 | A * | 10/1954 | Miller | 239/318 |
| 3,503,418 | A * | 3/1970 | Petrucci et al. | 137/515 |
| 4,609,149 | A * | 9/1986 | Jessen | 239/310 |
| 4,807,783 | A * | 2/1989 | van Zijverden | 239/318 |
| 6,230,982 | B1 * | 5/2001 | Newton | 239/310 |

* cited by examiner

*Primary Examiner*—Steven J. Ganey
(74) *Attorney, Agent, or Firm*—Kean, Miller, Hawthorne, D'Armond, McCowan & Jarman, L.L.P.

(57) ABSTRACT

This invention relates to equipment and a method for providing superior power washing at relatively low pressures. The equipment uses a unique mixing chamber wherein a pressurized water stream is mixed with a pressurized additive stream. For example, the additive stream enters the mixing chamber at a pressure at least that of the carrier, or water, stream. There is no need to operate the carrier liquid stream at substantially higher pressures than the desired delivery pressure.

5 Claims, 2 Drawing Sheets

HIGH PRESSURE FLUID SPRAYING APPARATUS

FIELD OF THE INVENTION

The present invention relates to equipment and a method for providing superior power washing at relatively low pressures. The equipment uses a unique mixing chamber wherein a pressurized water stream is mixed with a pressurized additive stream. For example, the additive stream enters the mixing chamber at a pressure at least that of the carrier, or water, stream. There is no need to operate the carrier liquid stream at substantially higher pressures than the desired delivery pressure.

BACKGROUND OF THE INVENTION

Pressurized fluid jet technology is well known and is used today in various applications, such as for eroding, debriding as well as removing contaminants from metal surfaces. For example, high pressure fluid jet technology has been used to effectively remove loose paint, rust and other gross contaminants from surfaces. It has also effectively been used to remove water soluble salts that are often found deep within the microscopic pits of a substrate. In many cases, water alone is used as the fluid, particularly when the contaminant is not strongly adhered to the surface. In other cases, a surfactant is needed, particularly when the contaminant is a hydrocarbon material. In still other cases it is necessary to use an abrasive material, such as a particulate material of suitable particle size and hardness, to remove strongly adhered contaminants and to leave a clean surface.

The equipment used to create the pressurized fluid stream will vary depending on the desired delivery pressure of the fluid. For example, low pressure (about 500 to about 1,500 psi) and intermediate pressure (about 2,000 to about 3,500 psi) units are often portable and are typically used for cleaning equipment, pavements, etc. They are sometimes used in combination with water heaters and surfactant systems since chemical and/or thermal energy inputs are frequently required to augment these systems. The high pressure (about 5,000 to about 15,000 psi) and ultra high pressure (15,000 to 35,000 psi) units are often truck mounted, or are occasionally stationary where objects are brought to be cleaned. The high pressure and, particularly ultra high pressure, units are more hazardous to use since they operate at dangerously high hydraulic energy levels. Further, transportation and disposal costs for the large quantities of liquid wastes generated in a typical hdyrojet cleaning application can be substantial. Water jetting, particularly at pressures greater than about 5,000 psi, is considered to be an extremely dangerous operation. Each year, a number of deaths and serious injuries result either directly from lacerations or from infections due to "hyrodermic" injections of dirty plant water. Conversely, at lower, safer pressures, the process is simply not effective. Other disadvantages include poor visibility, relatively high equipment and operating costs, operator fatigue brought on by working with such high thrust devices, and high water consumption.

In conventional pressurized fluid technology the primary, or carrier fluid, of the pressurized fluid stream is accelerated at the desired velocity and an additive, be it an abrasive, or a liquid such as a surfactant, is entrained into the carrier stream by the vacuum created by the flowing carrier stream. Such a system has the disadvantage in that substantially higher pressures are required for the carrier fluid stream than the desired fluid delivery stream pressure. Also, mixing of an additive is often inadequate for certain uses. Therefore, there exists a need in the art for more effective pressurized fluid spraying apparatus.

SUMMARY OF THE INVENTION

In accordance with the present invention there is provided a pressurized fluid system employing a novel mixing device. The mixing device is comprised of an enclosed housing defining an enclosed chamber having an inlet port and an outlet port, which outlet port is opposite to said inlet port and substantially on the same longitudinal axis as said inlet port and which inlet port contains an upper edge and a lower edge and which outlet port contains an upper edge and a lower edge, which housing contains an injector sealingly connected thereto at a position that is substantially a 90° angle to said longitudinal axis and which is substantially equidistant between said inlet port and said outlet port, said injector comprising an internal bore that ends at a discharge outlet that can be directed along a horizontal plane within a space defined by a first substantially horizontal line being drawn from the upper edge of said inlet port and said upper edge of said outlet port and a second substantially horizontal line being drawn from the lower edge of said inlet port and said lower edge of said outlet port.

Also in accordance with the present invention there is provided a high pressurized fluid spraying apparatus comprised of:

- a first pressure pump having an inlet connectable to a source of carrier liquid to receive carrier liquid therefrom;
- a power source for driving said first pressure pump;
- a pressure regulator connected to said first pressure pump to receive carrier liquid therefrom and to deliver said pressurized liquid at a controlled pressure;
- a container for containing an additive;
- a second pressure pump having an inlet connected to a said container to receive additive therefrom and having an outlet;
- a power source for driving said second pressure pump;
- a mixing device comprised of an enclosed housing defining a chamber having an inlet port and an outlet port, which inlet port is fluidly connected to said first regulator for receiving high pressure carrier liquid, and which outlet port is opposite to said inlet port and substantially on the same longitudinal axis as said inlet port and which inlet port contains an upper edge and a lower edge and which outlet port contains an upper edge and a lower edge, which housing further contains an injector sealing connected thereto at a position that at substantially a 90° angle to said longitudinal axis and which is substantially equidistant between said inlet port and said outlet port, said injector comprising an internal bore that ends at a discharge outlet that can be directed along a horizontal plane within between a space defined by a first substantially horizontal line being drawn from the upper edge of said, inlet port and said upper edge of said outlet port and a second substantially horizontal line being drawn from the lower edge of said inlet port and said lower edge of said outlet port, and which injector also contains a inlet being fluidly connected to said outlet of said second pressure pump for receiving high pressure additive; and
- a wand having an inlet and an outlet wherein said inlet is fluidly connected to said outlet port of said mixing device for receiving a high pressure mixture of additive and carrier liquid and being capable of spraying said additive and carrier liquid out of the outlet of said wand.

In a preferred embodiment, both the first pressure pump and the second pressure pump are driven by the same power source.

In another preferred embodiment the power source is a diesel motor.

In yet another preferred embodiment the additive contains an abrasive material.

DETAILED DESCRIPTION OF THE INVENTION

The apparatus of the present invention has several advantages over conventional pressurized fluid systems, particularly high pressure fluid systems. For example, by feeding the additive stream at at least the same pressure as the carrier liquid stream to the gun, or wand ensures that the exit, or delivery pressure is at least the same pressure as the carrier stream. It is preferred that both the carrier stream and the additive stream enter the apparatus of the present invention at substantially the same pressure. Consequently, there is no need to operate the pressure pump on the carrier liquid side at a substantially higher pressures than the desired delivery pressure. Also, since a lower pressure can be used to accomplish the washing and surface treatment effect of higher pressure systems, the system of the present invention is inherently safer.

Figure 1:
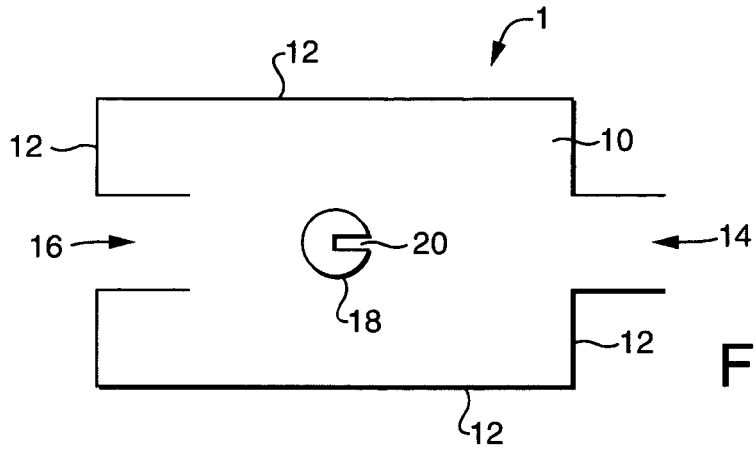
FIG. 1 is a top cross-sectional view along line A—A and looking downward in the direction of arrows aa, as shown in FIG. 3 hereof, of the mixing device of the present invention. This view shows the discharge bore of the injector directed toward the inlet port, which will provide maximum mixing of additive and carrier liquid.
Figure 3:
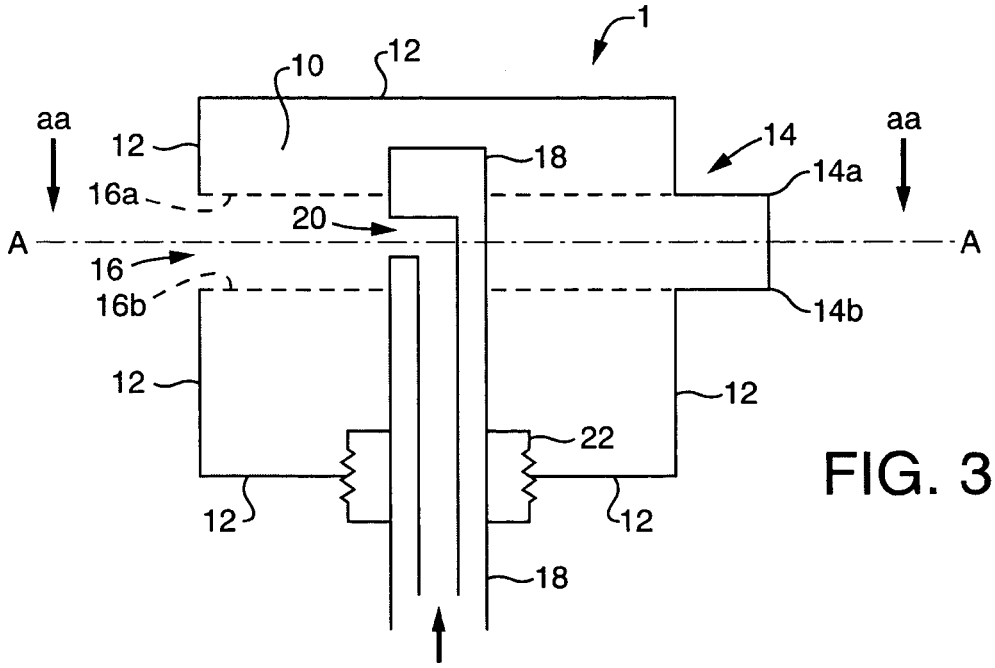
FIG. 3 is a side cross-section view along line B—B and viewed in the direction of arrows bb (FIG. 2). This view shows the injector projected into the mixing chamber with a discharge port within a horizontal zone defined by the top and bottom of both the inlet port and the outlet port.

FIG. 1 hereof is a top cross-sectional view of the mixing device MD, or 1 of the present invention along line A—A and viewed downward in the direction of arrows aa (FIG. 3), of the mixing device of the present invention. The mixing device 1 defines a chamber 10 that is enclosed by walls 12 except for inlet port 14 and outlet port 16. Top and bottom walls are not shown in this figure, but are shown in FIG. 3 hereof. Inlet port 14 is for receiving a pressurized carrier liquid and outlet port 16 is for delivering a pressurized fluid to a delivery means. Both the inlet port 14 and outlet port 16 will be constructed of suitable connecting means design to allow for other parts of the apparatus to be detachable connected. A preferred connecting means at each port can contain appropriate threads to receive either standard male of female members having complementary treads.

The mixing device also contains an injector 18 having a discharge port 20. Injector 18 can be rotated 360° so that it can deliver a pressurized stream of additive at any location within the horizontal plane which is located within a horizontal zone, which will be discussed in more detail below.

Figure 2:
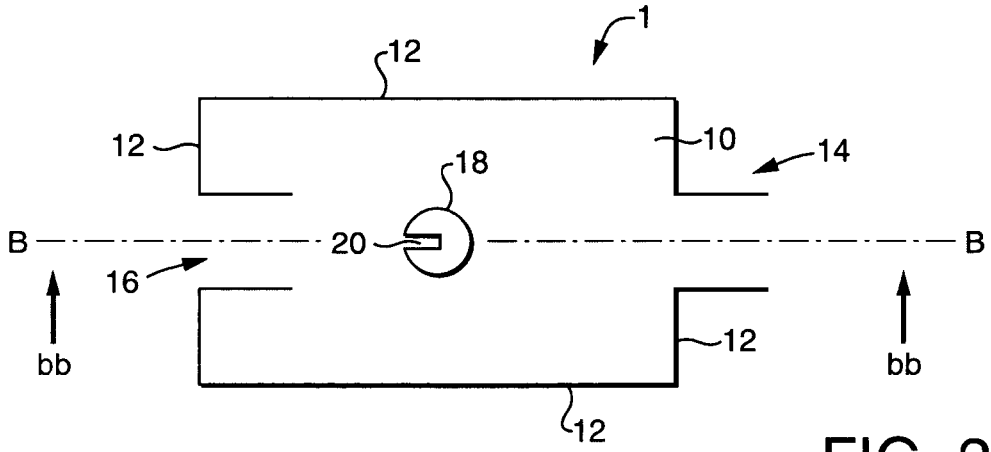
FIG. 2 is also a top cross-sectional view along line A—A (FIG. 3) as viewed in the direction of arrows aa (FIG. 3) of the mixing device of the present invention. This view shows the discharge of the injector facing the outlet port. This will provide minimum mixing of additive material with carrier liquid.

FIG. 1 shows the discharge port 20 of injector 18 positioned counter to any flow of carrier liquid entering inlet port 14. That is, discharge port 20 faces inlet port 14. FIG. 2 hereof shows discharge port 20 positioned concurrent with any flow of carrier liquid. That is, discharge port 20 faces outlet port 16. One important feature of the present invention is the ability to swivel the discharge port 20 of injector 18 to any location along the horizontal plane in which it is vertically positioned. This horizontal plane will be within the horizontal zone defined by the top and bottom of the inlet and outlet ports. This allows a greater degree of control of mixing of the additive material with the carrier liquid from either maximum as shown in FIG. 1 to minimum as shown in FIG. 2 hereof.

FIG. 3 is a side cross-sectional view of the mixing device as viewed along line B-B and viewed in the direction of arrows bb. FIG. 3 shows injector 18 sealingly connected to the bottom of mixing device 1 by any suitable means 22. This suitable connecting means 22 will be one that will allow the injector to be rotated a full 360°, but will still prevent fluid from leaking therefrom. Discharge port 20 will preferably be positioned at some point within the horizontal zone defined by an upper boundary by drawing an imaginary line from the top 14*a* of inlet port 14 to the top 16*a* of outlet 16. The lower boundary of the horizontal space is defined by drawing an imaginary line from the bottom 14*b* of inlet port 14 to the bottom 16*b* of outlet port 16. The mixing device can be comprised of any suitable material, preferably a stainless steel.

Figure 4:
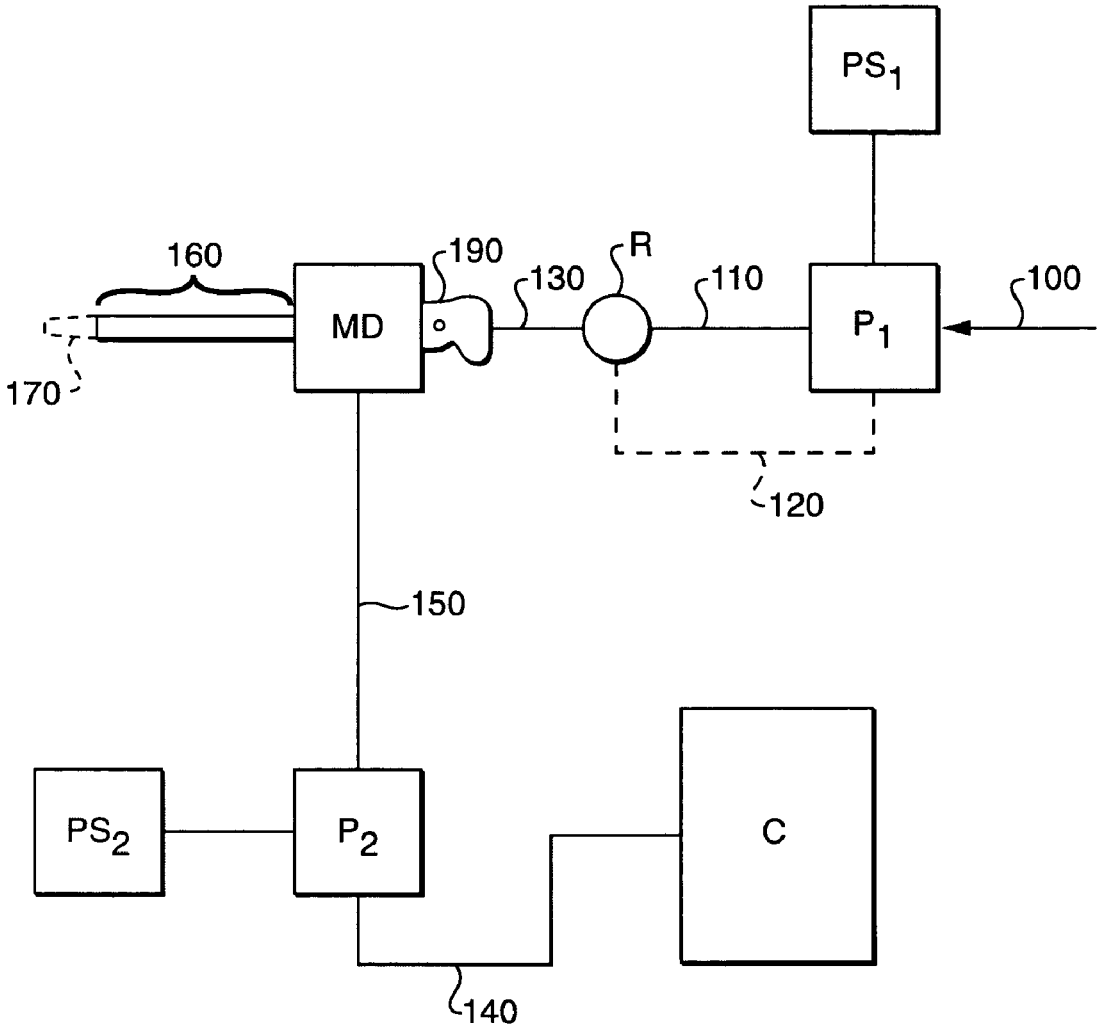
FIG. 4 is a schematic of the hydraulic circuit of a preferred embodiment of the present invention.

FIG. 4 hereof is a schematic of the hydraulic circuit of the apparatus of the present invention. A carrier liquid, preferably water, is conducted from a source, not shown, to first pressure pump $P_1$ via line 100. Pressure pump $P_1$ can be any pump suitable for pumping a liquid, preferably water, at pressures at which the present invention is practiced. Suitable pressure ranges for the practice of the present invention will be from about at least an effective pressure to up to about 4,000 psig, preferably from about 100 psig to about 4,000 psig, and more preferably from about 1,000 psig to about 3,500 psig. Liquid delivered from the pressure pump $P_1$ in excess of that used in the remainder of the system is optionally by-passed back to the pump through an optional by-pass line 120. Non-limiting examples of pumps that can be used in the practice of the present invention for both pump $P_1$ and $P_2$ include hydraulic pumps as well as air driven pumps. The most preferred type of pump is a plunger pump that is well known in the art. Pressure pump $_1$ is driven by power source $PS_1$ that can be any conventional power source suitable for driving pressure pump $P_1$. Non-limiting examples of suitable power sources include gasoline driven motors, diesel driven motors, as well as electric motors. Diesel motors are preferred as the power source.

The pressurized liquid stream will then be passed via line 110 to regulator R where the pressure can be more readily controlled. The controlled pressurized liquid is then conducted via line 130 to pistol grip handle with a trigger valve 190 to mixing device MD where it enters the mixing chamber 10 of FIGS. 1–3 hereof. The additive is introduced from tank C via line 140 to second pressure pump $P_2$. This second high pressure pump $P_2$ can be any pump suitable for delivering the additive of choice. Second pump $P_2$ delivers, via line 150 a pressurized additive stream to injector 18 of mixing device MD shown in FIG. 3 hereof. Second pressure pump $P_2$ will be self regulated in that it will most preferably have a built-in regulator for regulating pressure. It will be understood that if an additive is used which does not contain an abrasive a separate regulator, external to pressure pump $P_2$ can be used to regulate the pressure of pressure pump $P_2$. Pressure pump $P_2$ will be driven by a power source $PS_2$ that can be a type as described for power source $PS_1$. Although this figure shows separate power sources for each pressure pump, it is to be understood that it may be more preferred that both pressure pumps be driven by the same power source.

The mixed additive/carrier liquid stream is conducted through wand 160 that is also preferably provided with a suitable nozzle 170 of suitable size and having a suitable orifice size for the intended purpose of the apparatus. The intended purpose will preferably include cleaning hard surfaces as well as removing coatings, such as paint from hard surfaces. The most preferred hard surface will be a metal surface. The additive can be any material that is typically used in pressurized fluid systems. Non-limiting examples of additives suitable for use in the practice of the present invention are surfactants, and solvents such as alcohols. Most preferred are preferably surfactants.

It is within the scope of the present invention that an abrasive material be used within carrier to comprise the additive stream. Non-limiting examples of abrasive carriers include water, short chain alcohols, mineral oil, glycerine, or mixtures thereof. Non-limiting examples of abrasive materials suitable for use herein include glass, silica sand, iron, silicon carbide, as well as elemental metal and metal alloy slags and grits. Also useful are garnet and aluminum oxide. The abrasives may also be an encapsulate particle. For example, any of the preceding materials may be coated with an agent tending to provide a given physical or chemical effect. Encapsulating coatings may be any composition which, preferably, maintains the free flowing capability of the abrasive while imparting a given effect to processing. For example, abrasives may be coated with oxidation agents such as permanganates.

The particle size of these abrasives may range generally to any size which is capable of removing material from the intended substrate while also forming a homogenous fluid with the other constituents of the composition. Useful particle sizes have been found to be from about 7 mesh to 270 mesh (2.8 mm to 53 microns), preferably about 12 mesh to 150 mesh (1.4 mm to 106 microns) and most preferably about 60 to 115 mesh (250 microns to 125 microns). Generally, most preferred abrasives have been found to be garnet or aluminum abrasives having a particle size ranging from about 60 to 115 mesh.

The concentration of the abrasive within the composition may range generally in slurry fluid jet systems from about 1 to 50 wt-%, preferably from about 10 to 40 wt-%, and most preferably from about 25 to 35 wt-%. For entrained fluid jet systems the abrasive generally comprises about 5 wt-% to 30 wt-%, preferably 10 wt-% to 25 wt-% of total fluid flow depending on nozzle diameter such as diameters of about 0.01 inch.

What is claimed is:

1. A mixing device for use with a high pressure liquid jet system comprised of an enclosed housing defining an enclosed chamber having an inlet port and an outlet port, which outlet port is opposite to said inlet port and substantially on the same longitudinal axis as said inlet port and which inlet port contains an upper edge and a lower edge and which outlet port contains an upper edge and a lower edge, which housing contains an injector sealingly connected thereto at a position that is substantially a 90° angle to said longitudinal axis and which is substantially equidistant between said inlet port and said outlet port, said injector comprising an internal bore that ends at a discharge outlet that can be directed along a horizontal plane within a space defined by a first substantially horizontal line being drawn from the upper edge of said inlet port and said upper edge of said outlet port and a second substantially horizontal line being drawn from the lower edge of said inlet port and said lower edge of said outlet port, which injector is rotatable 360° within said horizontal plane.

2. The mixing device of claim 1 which is comprised of stainless steel.

3. A high pressure fluid spraying apparatus comprised of:

a first high pressure pump having an inlet connectable to a source of carrier liquid to receive carrier liquid therefrom;

a power source for driving said first high pressure pump;

a first high pressure regulator connected to said first high pressure pump to receive carrier liquid therefrom at high pressure and to deliver said high pressure liquid at a controlled pressure;

a container for containing an additive;

a second high pressure pump having an inlet connected to said container to receive additive therefrom;

a power source for driving said second high pressure pump;

a mixing device comprised of an enclosed housing defining a chamber having an inlet port and an outlet port, which inlet port is fluidly connected to said first regulator for receiving high pressure carrier liquid, and which outlet port is opposite to said inlet port and substantially on the same longitudinal axis as said inlet port and which inlet port contains an upper edge and a lower edge and which outlet port contains an upper edge and a lower edge, which housing further contains an injector sealingly connected thereto at a position that is substantially a 90° angle to said longitudinal axis and which is substantially equidistant between said inlet port and said outlet port, said injector comprising an internal bore that ends at a discharge outlet that can be directed along a horizontal plane within between a space defined by a first substantially horizontal line being drawn from the upper edge of said inlet port and said upper edge of said outlet port and a second substantially horizontal line being drawn from the lower edge of said inlet port and said lower edge of said outlet port, and which injector also contains a inlet being fluidly connected to said outlet of said second pressure pump for receiving high pressure additive; and a wand having an inlet and an outlet wherein said inlet is connected to said outlet port of said mixing device for receiving a high pressure mixture of additive and carrier liquid and spraying it out of the outlet of said wand.

4. The apparatus of claim 3 wherein each high pressure pump is driven by a separate power source.

5. The apparatus of claim 3 wherein each high pressure pump is driven by the same power source.

* * * * *